United States Patent [19]

Bard

[11] Patent Number: 4,633,633

[45] Date of Patent: Jan. 6, 1987

[54] WATERPROOF FLOOR FORMATION

[75] Inventor: Martin Bard, Amberg, Fed. Rep. of Germany

[73] Assignee: Buchtal Gesellschaft mit beschrankter Haftung, Amberg, Fed. Rep. of Germany

[21] Appl. No.: 777,220

[22] Filed: Sep. 18, 1985

[30] Foreign Application Priority Data

Sep. 20, 1984 [DE] Fed. Rep. of Germany ..... 3434559

[51] Int. Cl.[4] ..... E04F 13/08

[52] U.S. Cl. ..... 52/384; 52/390; 52/408

[58] Field of Search ..... 52/169.14, 384–392, 52/408–410, 747; 404/18

[56] References Cited

U.S. PATENT DOCUMENTS

| | | | |
|---|---|---|---|
| 703,928 | 7/1902 | Hutchinson | 52/390 X |
| 712,193 | 10/1902 | Kane | 52/390 |
| 1,702,912 | 2/1929 | McCoy | 52/390 |
| 2,298,983 | 10/1942 | Stabe | 52/384 |
| 4,315,392 | 2/1982 | Sylvest | 52/408 X |
| 4,546,024 | 10/1985 | Brown | 52/384 X |

*Primary Examiner*—John E. Murtagh
*Assistant Examiner*—Richard E. Chilcot, Jr.
*Attorney, Agent, or Firm*—Price, Heneveld, Cooper, DeWitt & Litton

[57] ABSTRACT

In a waterproof floor formation, in which an asphalt-coated sheet with a covering of ceramic tiles thereupon is laid on a supporting base (or floor pavement), the asphalt covering on the asphalt-coated sheet facing the supporting base is less thick than the asphalt covering located on the other side, and the ceramic tiles are provided with a relief structure on the side facing away from the visible side. Thus, a waterproof floor formation is proposed which rules out the danger of the waterproof sheets being damaged when the tile material is laid and, furthermore, by which an even, smooth visible side of the floor covering can be obtained in every case.

6 Claims, 1 Drawing Figure

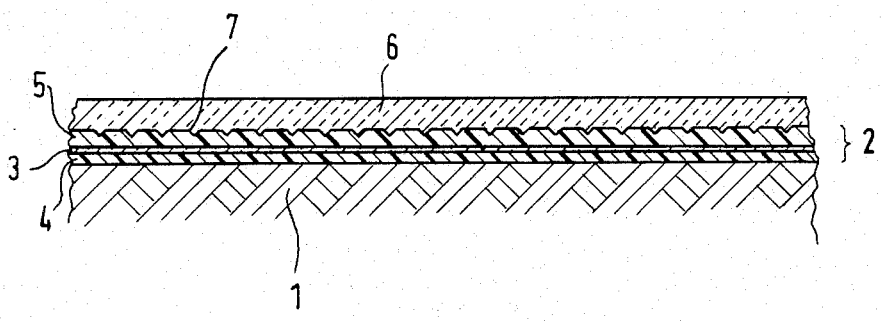
7
6
5
3
4
1
2

WATERPROOF FLOOR FORMATION

The present invention relates to a waterproof floor formation in which an asphalt-coated sheet with a covering of ceramic tiles thereupon is laid on a supporting base or floor pavement.

The invention further relates to a method for laying ceramic tiles.

If constructions such as balconies, terraces, passages around swimming pools, shower areas and the like are to be protected against moisture, they must be sealed by aid of asphalt sheets and the like.

If ceramic material, e.g. in the form of split tiles, are to be used on the visible side or as the uppermost layer, an intermediate layer must be prepared as a load-resistant laying base. This base generally consists of a cement-bound intermediate layer installed moist, on which the ceramic units, in particular tiles, are laid. The joints between these units are then closed with material having the same structure of matter.

It is also known from prior public use to line a supporting base or floor pavement with an asphalt-coated sheet, for example a mineral fiber or glass fiber sheet, flame this sheet and then lay ceramic tiles, i.e. so-called "split tiles", on the softened surface.

Split tiles are tiles which are obtained by separating two tiles joined back to back by webs. The separation leaves part of the webs, and thus fin-like formations, on the backs of the tiles so that the asphalt sheet may be damaged when such tiles are laid, thereby endangering the waterproofness of the floor formation. Furthermore, the portions of the webs which remain after separation are uneven, so that the the ductile asphalt layer available for embedding may possibly be too thin, at least locally. This leads to the danger of not obtaining a smooth uninterrupted visible surface of the floor formation formed by tiles, because the tolerances of the base are not compensated completely.

The invention is based on the problem of proposing a waterproof floor formation and a method for producing it, in which the danger of the waterproof sheets being damaged when the tile material is laid is ruled out and, furthermore, an even, smooth visible side of the floor covering can be obtained in every case.

The inventive waterproof floor formation, in which an asphalt-coated sheet, preferably a mineral fiber or glass fiber sheet, with a covering of ceramic tiles thereupon is laid on a supporting base or floor pavement, is characterized by the fact that the asphalt covering of the asphalt-coated sheet facing the supporting base is less thick than the covering located on the other side, and by the fact that the ceramic tiles are provided with a relief structure on the side facing away from the visible side.

Such tiles are relatively thin ceramic tiles, the relief structure consisting merely of continuous fins possibly protruding only by a fraction of a millimeter, but without any sharp edges. Their height is generally 8% of the tile thickness at the most. Such tiles can be handled and laid without any difficulty, whereby the thicker asphalt layer on the side of the asphalt-coated sheet facing the tiles makes sure that the tiles can be embedded completely and cleanly in such a way as to result in an altogether even and clean floor formation.

It is particularly advantageous when the asphalt surfaces are not sanded using stone chips as is usual, but instead at least the surface of the asphalt covering of the asphalt-coated sheet facing the tiles is provided with a fine-grain, preferably powdery sanding. This ensures that the tiles are embedded with particular stability and anchored in the asphalt.

The asphalt covering of the asphalt-coated sheet should expediently have a temperature range of 100° C. between its breaking point, which is usually about −30° C., and its softening point, which is then around 70° C.

The inventive method for laying ceramic tiles involves, as does the prior art, lining a supporting base with an asphalt-coated sheet, e.g. a mineral fiber or glass fiber sheet, flaming this sheet so that the asphalt coating softens and then laying the ceramic tiles on the softened upper layer. However, the asphalt-coated sheet used according to the invention is one which has asphalt coverings of differing thicknesses on the two sides of the asphalt-coated sheet, i.e. the mineral fiber or glass fiber sheet. This sheet is laid with the side bearing the thinner asphalt covering on the supporting base or floor pavement and then flamed in a manner known as such. The flaming is directed to the thicker asphalt covering. The ceramic tiles, i.e. a special kind of ceramic tile having a relief structure on the side facing away from the visible side, are then laid on this softened asphalt covering.

The asphalt-coated sheet preferably used is a mineral fiber or glass fiber sheet but possibly also a sheet made of other inorganic or organic fibers or threads, on which the thicker asphalt covering is one and a half times to twice as thick as the thinner asphalt covering, but at least three times as thick as the depth of the relief structure of the ceramic tiles.

The sanding on the asphalt surfaces expediently consists, at least on the side of the asphalt-coated sheet facing the ceramic tiles, not of a coarse-grain material such as stone chips, but of a particularly fine-grain material which may even be in powder form.

The drawing shows in one FIGURE a cross-section of a floor formation according to the invention.

The supporting base or floor pavement is referred to as 1. The asphalt-coated sheet, for example a glass fiber sheet 3, bearing an asphalt layer 4 on the side facing the base 1 and an asphalt layer 5 on the other side, is referred to as 2. Asphalt layers 4 and 5 do not differ with respect to the asphalt used, but with respect to their thicknesses. The thickness of layer 5 in the embodiment is one and a half times to twice the thickness of layer 4. When sheet 2 has been laid on base 1, sheet 2 is flamed so that the asphalt layers soften, whereby asphalt layer 4 forms a bond with the surface of base 1. Ceramic tiles, of which only one is indicated at 6, are pressed into the softened asphalt layer 5. This ceramic tile 6 has a relief structure 7 at right angles to the plane of projection which is shown by corresponding small projections on the plane of projection. The relief structure may of course be of a great number of kinds. It may extend obliquely to the edges of the tiles, consist of projections which cross over one another or be designed in any other useful manner. What is essential is the thickness of asphalt layer 5, which is preferably at least three times as thick as the depth of relief structure 7, as the drawing attempts to show. The floor formation need not necessarily extend completely horizontally, of course. It may also be a sloping floor formation, or at least part of a walling which is even practically vertical.

I claim:

1. A waterproof floor formation for application over a rigid support surface, a laminated sheet having upper and lower layers and an intermediate layer of fibrous material; a surface of ceramic tile, said tile having a relief formed on their lower faces; said upper and lower layers of said sheet each being formed of asphalt; said lower layer providing a bonding means for securing said sheet to the support surface; the upper layer being thicker than said lower layer and providing a bonding means for securing and supporting the tile; the depth of the relief on the tile being less than the thickness of said upper layer whereby said relief does not contact said intermediate layer when said tile have been laid to form a smooth, flat surface.

2. The floor formation according to claim 1, wherein at least the surface of the asphalt covering on the asphalt-coated sheet facing the ceramic tiles is provided with a fine-grain, preferably powdery sanding.

3. The floor formation according to claim 1, wherein the height of the relief structure on the side of the ceramic tiles facing away from the visible side is 8% of the tile thickness at the most.

4. The waterproof floor formation described in claim 1 wherein the upper layer of asphalt is between one and one-half and twice the thickness of the lower layer and said upper layer is at least three times as thick as the depth of the relief on the ceramic tiles.

5. The waterproof floor as described in claim 1 wherein a fine-grain, preferably powdery sanding is applied at least to the surface of the upper layer of asphalt.

6. The waterproof floor according to claim 5, wherein the asphalt covering on the laminated sheet has a temperature range of 100° C. between its breaking point and its softening point.

* * * * *